US005921471A

United States Patent [19]

Vivier et al.

[11] Patent Number: 5,921,471

[45] Date of Patent: Jul. 13, 1999

[54] HEAD FOR GENERATING AND FOR SPRAYING FOAM, IN PARTICULAR FOR A FIRE EXTINGUISHER

[75] Inventors: Daniel Vivier, Sussargues Castries; Roger Laine, Broglie, both of France

[73] Assignee: SNC S2E Services, Lyon, France

[21] Appl. No.: 08/906,826

[22] Filed: Aug. 6, 1997

[30] Foreign Application Priority Data

Aug. 30, 1996 [FR] France ..... 96 10805

[51] Int. Cl.[6] ..... B05B 1/26; E03C 1/08

[52] U.S. Cl. ..... 239/428.5; 239/526; 239/543; 239/545

[58] Field of Search ..... 239/500, 501, 239/504, 520, 526, 541, 544, 518, 419.5, 421, 426, 427, 427.3, 428.5, 432, 433, 470, 545; 169/14, 15, 30, 37, 74; 261/DIG. 26, 78.2

[56] References Cited

U.S. PATENT DOCUMENTS

| | | | |
|---|---|---|---|
| 2,289,352 | 7/1942 | Ensminger | 239/520 X |
| 2,527,891 | 10/1950 | Pulver et al. . | |
| 2,621,076 | 12/1952 | Barton | 239/526 X |
| 2,792,260 | 5/1957 | Wood | 239/526 |
| 3,672,574 | 6/1972 | Knapp | 239/428.5 |
| 3,693,884 | 9/1972 | Snodgrass et al. | 239/432 X |
| 3,836,076 | 9/1974 | Conrad et al. | 239/432 X |
| 5,358,179 | 10/1994 | Lund et al. | 239/544 X |
| 5,382,389 | 1/1995 | Goodline et al. | 169/15 X |

FOREIGN PATENT DOCUMENTS

| | | |
|---|---|---|
| 633862 | 12/1949 | United Kingdom . |
| 2171615 | 9/1986 | United Kingdom . |

*Primary Examiner*—Andres Kashnikow
*Assistant Examiner*—Steven J. Ganey
*Attorney, Agent, or Firm*—Oliff & Berridge, PLC

[57] ABSTRACT

A head for generating and spraying foam is provided. The head is particularly useful in a fire extinguisher. The head includes a nozzle for spraying foam in a praying direction, at least two conduits for supplying a fluid, and a boss. A. wall at the outlet end of each conduit is oriented approximately perpendicular to the spraying direction. The conduits each emerge into a base of the nozzle via openings. A fluid is supplied to the conduits. During travel of the fluid to the nozzle, the fluid encounters a double deflection. The first deflection is from the wall within the conduit towards the boss. The second deflection is from the boss towards the wall of the nozzle. This double deflection path of travel causes the fluid to become completely emulsified with ambient air to create a large volume of high quality spraying foam.

12 Claims, 1 Drawing Sheet

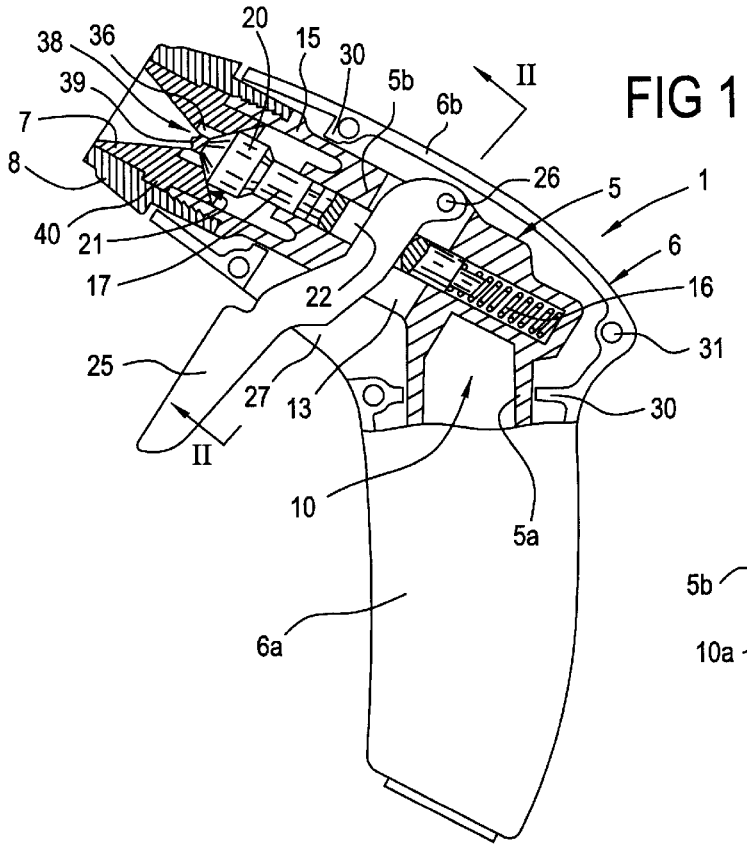
FIG 1
FIG 2
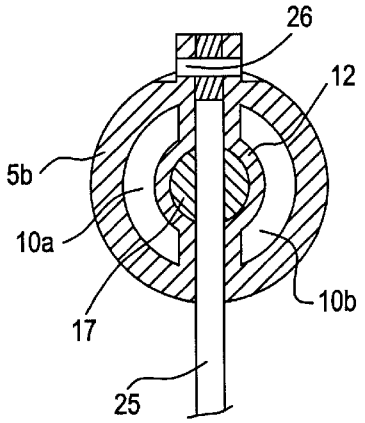
FIG 3
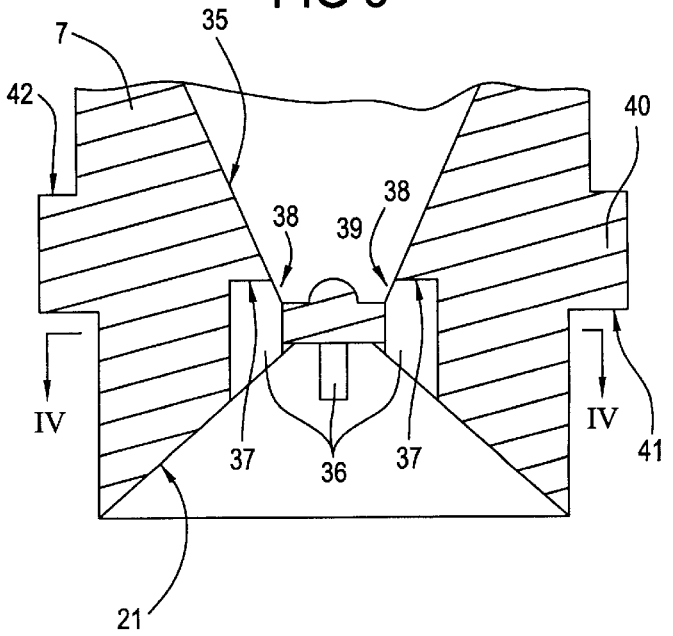
FIG 4
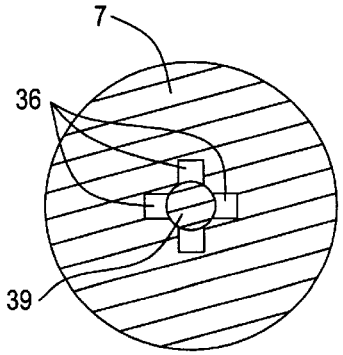

HEAD FOR GENERATING AND FOR SPRAYING FOAM, IN PARTICULAR FOR A FIRE EXTINGUISHER

BACKGROUND OF THE INVENTION

The subject of the present invention is a head for generating and for spraying foam, in particular for a fire extinguisher.

DESCRIPTION OF THE PRIOR ART

Some fire extinguishers contain a fluid, generally a mixture of water and a chemical additive, suitable for being emulsified with air to form an extinguishing foam.

The spray heads which the known extinguishers comprise have the drawback of having a complex structure. This is because these heads comprise emulsion chambers having air inlet holes, means used to emulsify the mixture and the air, in particular turbines or chamber shapes suitable for producing a whirling flow, and grilles or screens, which are placed inside a nozzle for spraying the foam.

These heads are relatively complex to manufacture and assemble. this having an impact, in particular, on the manufacturing cost.

SUMMARY OF THE INVENTION

The present invention aims to remedy this draw-back by providing a head for generating and for spraying foam, producing a foam of good quality and in large quantity, while having a simple structure. The head to which the invention relates comprises in a manner which is itself known, a nozzle for spraying the foam produced.

According to the invention, the head furthermore comprises:

- at least two conduits for supplying the fluid intended to be foamed, which are uniformly distributed around the circumference of the head, these conduits terminating at their outlet end in walls oriented approximately perpendicular to the foam spraying direction, and emerging in the base of the nozzle via openings located at the same level with respect to each other, and
- a bass located opposite these openings, said walls being intended to deflect the fluid toward said boss, and this boss being intended to deflect the various fluid jets so that they mutually strike each other in the base of the nozzle.

This double deflection of the fluid jets, their encounter with the boss. their mutual striking and their encounter with the wall of the nozzle, allow perfect fluid/air mixing and produce a foam of good quality and in large quantity.

The head according to the invention thus comprises no moving parts of the turbine type, no emulsion chamber of complex structure, communicating with the outside via air intake holes, and no spray grille or screen.

By virtue of its simple structure, this head may be made of a molded synthetic material.

Preferably, the nozzle has an approximately conical shape, which widens out in the foam spraying direction. The conduit openings are thus not perpendicular to the foam spraying direction but inclined toward the outside, depending on the inclination of the wall of the nozzle. This inclination favors the deflection of the jets by the boss.

Advantageously, the aforementioned conduits, walls, openings, boss and nozzle are arranged in a ferrule fixed on the free end of the head.

This ferrule is particularly simple and easy to fit onto the head.

Preferably, the boss has a rounded, in particular hemispherical, shape which favors deflection of the jets and prevents them from breaking up before they strike each other.

Also preferably, the spray head comprises four conduits.

According to one embodiment of the invention, the head comprises a spray control valve, actuated by a mechanism. Advantageously. the head has a part in the form of a crook and a part in the form of a spray "gun", and comprises a trigger for actuating the foam spraying.

In order to make the invention clearly understood, it will be described again below, with reference to the appended diagrammatic drawing which represents, by way of nonlimiting example, a preferred embodiment of the head for generating and for spraying foam to which it relates.

BRIEF DESCRIPTION OF THE DRAWINGS

FIG. 1 is a side view, with partial longitudinal cross section;

FIG. 2 is a cross-sectional view along the line II—II in FIG. 1;

FIG. 3 is a view on a larger scale, in longitudinal cross section, of a ferrule which the head has at its free end, and FIG. 4 is a view of this ferrule in cross section along the line IV—IV in FIG. 3.

DESCRIPTION OF THE PREFERRED EMBODIMENT

FIG. 1 shows the head 1 for generating and for spraying foam which a fire extinguisher (not shown) comprises. This extinguisher comprises a pressurized tank connected to the head 1 via a hose, this tank containing a mixture of water and a chemical additive suitable for being emulsified with air in the head 1 in order to form an extinguishing foam.

This head 1 has an internal body 5, an external casing 6 surrounding the body 5, a spray control valve, actuated by a mechanism housed in the body 5, a ferrule 7 for generating the foam, and a bushing 8 for fitting ferrule 7 onto an outlet end of the body 5.

The body 5 and the casing 5 each have a part 5*a*, 6*a* forming a crook and a part 5*b*, 6*b* forming a spray "gun".

The parts 5*a* and 5*b* delimit a main fluid supply conduit 10 connected, at the base of the part 5*a*, to the hose (not shown) of the extinguisher. This conduit 10 is a single conduit in the part 5*a* and divides in the part 5*b* into two side conduits 10*a*, 10*b* which meet to the rear of the ferrule 7.

As may be seen, this part 5*b* comprises, between the side conduits 10*a*. 10*b*, a tubular wall 12 delimiting an axial bore, this bore being closed at its end opposite the ferrule 7. The part 5*b* also comprises a housing 13 transverse to this bore, communicating with this bore and emerging on the outside of the body 5 on each side of the latter.

The part 5*b* furthermore comprises a threaded nozzle housing 15 projecting, coaxially with the bore, from the free end side of the head 1, this nozzle housing 15 including the ferrule 7 and the bushing 8.

A spring 16 and a rod 17 are engaged and able to slide in the bore. The spring 16 bears against the bottom of the bore and against one of the ends of the rod 17.

The other end of the rod 17 projects from the bore, and comprises a plug 20 made of a resilient material. The end of the plug 20 has a conical shape while the face of the ferrule 7 turned toward the inside of the head 1 comprises a conical seat 21 having the same slope. The end of the plug 20 can come into sealing contact with this conical seat 21 and is normally held in this position by the spring 16, the latter being compressed when the plug 20 is in contact with the seat 21.

The rod 17 also comprises a transverse housing 22 arranged at the height of and facing the housing 13. A trigger 25, mounted so as to pivot on the body 5 by means of a pin 26, passes through the two housings 13 and 22. This trigger 25 projects beyond the casing 6 through a slot 27 and bears against the wall of the rod 17 delimiting the housing 22 on the opposite side from the free end of the head 1.

Pressure exerted on the trigger 25, so as to move it closer to the part 6*a*, makes it possible to compress the spring 16 and move the plug 20 away from the seat 21, and therefore to cause fluid to flow through the ferrule 7 toward the outside.

Plug 20 and conical seat 21 consequently constitute the aforementioned spray control valve, and the rod 17/trigger 25/spring 16 assembly constitutes the mechanism for actuating this valve.

The casing 6 consists of two half-shells, one of which is show partially cut in FIG. 1. These two half-shells have flanges 30 for clamping the body 5 and are joined together by the engagement of studs or screws, which one of them has, in corresponding holes 31 made in the wall of the other.

The ferrule 7 is made as a single piece, by the molding of a synthetic material. As shown more particularly in FIGS. 3 and 4, it comprises, in addition to the seat 21:

a nozzle 35 for spraying the foam produced, the nozzle 35 being coaxial with the seat 21 and itself having a conical shape which widens out in a spraying direction;

four conduits 36 for supplying the fluid intended to be foamed, which are uniformly distributed around the circumference of the ferrule 7; these conduits 36 terminate at their outlet end in walls 37 oriented approximately perpendicular to the spraying direction, and emerge in the base of the nozzle 35 via openings 38 located at the same level with respect to each other;

a boas 39 of approximately hemispherical shape, located opposite these openings 38 and approximately equidistant from them, and an external collar 40, delimiting a shoulder 41, which can bear against the nozzle housing 15, and a shoulder 42.

Bushing 8 includes a shoulder which can bear against this shoulder 42 and an internal thread enabling it to be screwed onto the thread of the nozzle housing 15 so as to clamp the ferrule 7 between it and the end of nozzle housing 15.

The pressurized fluid, when it passes through the ferrule 7, is abruptly deflected by the walls 37 toward the boss 39. The four fluid formed by divergence from the four walls 37 then encounter the boss 39, which deflects them so that they mutually strike each other in the base of the nozzle 35 before encountering the wall of the conical nozzle 35.

The slight outward inclination of the openings 38, resulting from the conical shape of the nozzle 35, favors the deflection of the fluid jets by the boss 39.

The path of the fluid has two deflections. The first deflection is off of wall 37 towards boss 39. The second is off of boss 39 towards the wall of nozzle 35, during which the fluid jets mutually strike each other. This double deflection allows the fluid to become completely emulsified with ambient air to produce a large quantity of good quality foam.

The present invention thus enables this result to be obtained by means of a head 1 which has a very simple structure and is inexpensive to manufacture, thereby remedying the drawbacks of the heads for generating and for spraying foam according to the prior art.

We claim:

1. A head for generating and spraying foam, comprising:

a nozzle that sprays the foam in a foam spraying direction, said nozzle having a base;

at least two conduits that supply a fluid to be foamed, said at least two conduits being uniformly distributed around the head, each of said at least two conduits terminating at an outlet end with a wall oriented approximately perpendicular to the foam spraying direction and including an opening emerging into said base of said nozzle, said openings being radially aligned with each other; and a boss located opposite said radially aligned openings, wherein fluid traveling through said at least two conduits deflects off of one of said walls towards said boss and further deflects off of said boss towards said nozzle, allowing individual fluid jets of the fluid to mutually strike each other in said base of said nozzle and mix with ambient air to create a spraying foam from the fluid that is sprayed by said nozzle.

2. The head of claim 1, wherein said head is made of a molded synthetic material.

3. The head of claim 1, wherein said nozzle is approximately conical and widens in the foam spraying direction.

4. The head of claim 1, wherein an outlet end of said head includes a ferrule which contains said conduits, said boss and said nozzle.

5. The head of claim 1, wherein said boss has a hemispherical shape.

6. The head of claim 1, wherein said at least two conduits comprises four conduits.

7. The head of claim 1, further comprising a spray control valve that controls dispensing of the fluid.

8. The head of claim 7, wherein said spray control valve comprises a movable plug and a seat.

9. The head of claim 7, further comprising a mechanism that actuates said spray control valve.

10. The head of claim 9, wherein said mechanism comprises a rod connected to said spray control valve, a spring bearing against one end of said rod, and a trigger connected to said rod.

11. The head of claim 9, wherein said head includes a crook-shaped body and a trigger that forms part of said mechanism.

12. A fire extinguisher containing he head recited in claim 1.

* * * * *